United States Patent [19]

Royer

[11] 4,445,982

[45] May 1, 1984

[54] PROCESS FOR PRODUCING A DESIGN COMPOSED OF TWO DIFFERENT MATERIALS ON THE SURFACE OF AN OBJECT

[75] Inventor: Michel E. Royer, La Balme de Sillingy, France

[73] Assignee: S. T. Dupont, Paris, France

[21] Appl. No.: 463,770

[22] Filed: Feb. 4, 1983

[30] Foreign Application Priority Data

Feb. 8, 1982 [FR] France ..... 82 01992

[51] Int. Cl.[3] ..... C25O 5/02

[52] U.S. Cl. ..... 204/18.1

[58] Field of Search ..... 204/18.1, 38 E

[56] References Cited

U.S. PATENT DOCUMENTS 2,028,013 1/1936 Reilly ..... 204/18.1

2,691,627 10/1954 Johnson ..... 204/18.1

2,847,370 8/1958 Howard ..... 204/18.1

3,065,152 11/1962 Douglass ..... 204/18.1

FOREIGN PATENT DOCUMENTS 2017010 9/1979 United Kingdom .

*Primary Examiner*—T. Tufariello

*Attorney, Agent, or Firm*—Robert A. Shack

[57] ABSTRACT

A process for producing on an object a decoration which includes two different visible materials, said process including at least one cycle of the steps of applying a masking material to at least one region of the outer surface of the object, simultaneously machining the mask and the underlying base material over at least a portion of the region, and coating the machined portion of the underlying base material with a different material.

6 Claims, No Drawings

PROCESS FOR PRODUCING A DESIGN COMPOSED OF TWO DIFFERENT MATERIALS ON THE SURFACE OF AN OBJECT

BACKGROUND OF THE INVENTION

1. Field of the Invention

This invention relates to a method for producing a decoration composed of two different materials on the surface of an object.

2. Background of the Invention

Prior art processes are known for producing two-color decorations on metal objects. In one known process, the object is first plated with a first metal, a second different metal is then plated over the first metal, and selected portions of the first metal are then exposed by machining or chemically attacking the overlying second metal. Such a process is easily performed only upon objects having plain surfaces. Additionally, the machining depth must be quite precisely controlled such that it is deep enough to pass through the outermost metal coating without perforating the underlying metal coating.

It is also known to use a masking technique to produce two-color decorations on objects. In such a process, the entire object is initially coated with a first metal, an adhesive mask is then applied to selected areas of the object, and a second overlying metal is then deposited on the unmasked portions. Such a technique, however, nesessitates exact positioning of the mask upon the object. This may be difficult to accomplish, particularly in the case of small objects.

Moreover, such a technique is not well adapted to forming a fillet of a given width and of a different material surrounding one of the surfaces of an object. Since the mask has a given dimension, any dimensional variation in the object to be decorated will influence the width of the fillet obtained.

If such a fillet is produced as a groove bordering one surface of an object, the surface of the object and the surface of the groove adjacent to one another are coated with two different materials. As a result, any error in positioning and applying the mask will result in an irregular coating at the edge separating these two surfaces.

SUMMARY OF THE INVENTION

One object of the invention is to overcome the above mentioned disadvantages by describing a process wherein two adjacent surfaces of an object may be coated with different materials such that a particularly clean and well defined line of demarcation separates the two adjacent surfaces. Additionally, the process described is efficiently and easily performed in an industrial setting.

According to one aspect of the invention, a protective or masking material is applied to at least one outside surface of an object to be decorated, both the protective masking material and the underlying base material are then simultaneously machined over a portion of the masked surface, and the machine portions of the underlying base material are then coated with a second and different material.

In one embodiment, the mask is applied over the entire surface of the object. Thus, industrial production of such decorations may be simplified by including these unfinished and masked pieces in an existing machining sequence jointly with other products.

In another embodiment, the mask is removed to reveal the basic material of which the object is made. This embodiment is particularly advantageous when the base material is a precious material.

If the base material is not a precious metal or the like, the masking and machining operations may be proceeded by a step in which the surface of the base material is transformed, for example, by chemical attack or by deposition of a different material thereon.

DESCRIPTION OF THE PREFERRED EMBODIMENT

The term "mask" as used herein refers to any mask deposited on all or part of the object to be decorated, the mask serving to preserve the non-machined parts of the object from any transformation occurring during the subsequent coating step. The masked material will thus be chosen for its neutrality with respect to the products used during the coating step.

Thus, if the coating step involves electrolytic plating, the mask will be made of an insulating material.

Similarly, if the coating step is affected by deposition of a substance on the base material, for example, by dipping the machined object into a molten metal or by spraying a molten metal onto the machined object, the masked material will be chosen for its characteristics of non-wettability with respect to the deposited material, in order that the deposited material will not adhere to the mask.

As used herein, the term "coating" designates any surface modification of the base material. For example, the coating step may consist of a chemical transformation of the surface of the base material, such as by anodic oxidation. In such a case, the mask material is chosen for its non-reactive properties to such oxidation.

In general, the masked material will also be chosen for its good machinability properties, in order that the line of demarcation separating the different materials is clear and sharp.

If the machining step is to be performed industrially, it is necessary that the unfinished object be coated regularly by the mask and that the mask have a known and controllable thickness, so that it may be positioned precisely with respect to the machining tool. For this reason, particular emphasis is given to mask application processes which utilize electric field lines, for example, electrophoretic processes. Such processes produce notably regular deposits, even upon objects of relatively complicated shape. Moreover, the thickness of the mask is easily controllable by simply regulating the current and the process time. Finally, masks applied by such processes are electrical insulators which may be used in conjunction with a coating step employing electrolysis processes.

The present inventor has employed the process described and claimed herein to the manufacture of cigarette lighters having principle silver-plated surfaces surrounded with a fine gold border which is slightly depressed relative to the principle surfaces. After polishing, the unfinished body is silver coated by dipping it in an electrolysis bath of the traditional type. The entire surface of the lighter body is then coated with a mask approximately 10 microns thick by dipping it into an electrophoresis bath marketing under the name "Primaire Electrocationique Noir Type 700-980" CORONA. The principle surfaces of the unfinished piece thus masked are then machined to form the fillets, which are then gold plated by immersing the lighter body in an appropriate electrolysis bath of a known type.

Depending upon the purpose to be served by the object, it is possible either to preserve or remove the mask. The mask, when transparent, gives a shiny appearance to the surface of the object and, additionally, protects the surface from oxidation. If the mask is opaque, it may form an integral part of the decoration of the object.

When the present inventive process is employed in conjunction with objects having plain surfaces, masks may be formed by applying a paste with a roller, the mask being dried before the machining step. The mask may also be applied by spraying, dipping the object in a solution of masked material, or by any of the other means known in the art.

Upon completion of the process, the mask may be removed, for example, by dissolution.

The present inventive process may be used in conjunction with objects of any composition, even an electric insulator for example, such as plastic, which is first subjected to a preliminary metalizing step, e.g., such as vacuum metalizing.

Depending upon the degree and type of decoration desired, it is possible to repeat the process as many times as necessary. Moreover, additional steps may be included either before or after the three steps which characterize the present inventive process. Additional steps may also be inserted between any two of the three basic steps.

While the present invention has been described in conjunction with a particular preferred embodiment, various substitutions of equivalents may be effected which do not depart from the spirit or scope of the invention as set forth in the following claims.

What is claimed as new and desired to be secured by Letters Patent of the United States is:

1. A process for producing on an object made of a base material a decoration including at least two different materials, said process including at least one cycle comprising the steps of:

applying a removable masking material to at least one region of the outer surface of said object;

simultaneously machining said masking material and said underlying base material over at least a portion of said region;

coating the machined portion of said underlying base material with a second material differing from said base material; and substantially completely removing said masking material.

2. A process as in claim 1, wherein said coating step is carried out by deposition.

3. A process according to claim 2, wherein said deposition operation employs electric current lines.

4. A process as in claim 3, wherein said deposition operation employs electrolysis.

5. A process according to claim 1, wherein said mask is removed by dissolution.

6. A process as in claim 1, further comprising a preliminary metalizing operation.

* * * * *